United States Patent [19]

Eistrat

[11] 4,288,974

[45] * Sep. 15, 1981

[54] DULLED CONDUCTOR AND MAKING SAME

[76] Inventor: Thomas Eistrat, 1020 S. Almansor St., Alhambra, Calif. 91801

[ * ] Notice: The portion of the term of this patent subsequent to Apr. 17, 1996, has been disclaimed.

[21] Appl. No.: 100,787

[22] Filed: Dec. 5, 1979

Related U.S. Application Data

[63] Continuation-in-part of Ser. No. 869,850, Jan. 16, 1978, Pat. No. 4,149,367, and Ser. No. 12,168, Feb. 14, 1979, Pat. No. 4,198,807.

[51] Int. Cl.[3] ..... D07B 7/14

[52] U.S. Cl. ..... 57/223; 57/7; 57/217; 57/232

[58] Field of Search ..... 57/217, 221, 223, 232, 57/248, 258, 7, 8, 295, 309, 1, 6, 9, 13, 212, 241, 250, 292, 314, 296; 174/128 R, 130 R

[56] References Cited

U.S. PATENT DOCUMENTS

| | | | |
|---|---|---|---|
| 2,509,894 | 5/1950 | Toulmin et al. | 57/221 X |
| 2,977,748 | 4/1961 | Zisman et al. | 57/223 X |
| 3,053,039 | 9/1962 | Demmel | 57/295 |
| 3,761,346 | 9/1973 | Caroselli et al. | 57/248 X |
| 3,889,455 | 6/1975 | Portinari et al. | 57/7 |
| 3,923,003 | 12/1975 | Carden | 57/7 X |
| 3,988,884 | 11/1976 | Kikugawa | 57/223 X |
| 4,123,894 | 11/1978 | Hughes et al. | 57/221 X |
| 4,125,741 | 11/1978 | Wahl et al. | 57/217 X |

*Primary Examiner*—Donald Watkins

[57] ABSTRACT

Outdoor overhead supported transmission and distribution electrical and communication covered conductor and cable, whether the exterior cover is metal or plastic, is shiny and visible when newly installed in public view. These products may not become significantly dull until after many years of outdoor weathering. Many utilities have had to bury their transmission and distribution lines or building service drops because the public protested seeing them. This invention is for conductors which are inconspicuous and blend into the environment where they are to be used and the public would object if they were conspicuous. The exterior surface of the covers of these linear bodies are dulled or intermittently dulled so that they are not conspicuous and objectionable to the public. Non-specular jacketed light wave conductors are included. Several methods are claimed for these non-specularly dulled or camouflaged products. Cost and service life benefits are indicated for the plastic covered products. Non-specularly dulled and covered wire rope products are included.

20 Claims, 6 Drawing Figures

DULLED CONDUCTOR AND MAKING SAME

This is a continuation-in-part of Ser. No. 869,850, Jan. 16, 1978, now U.S. Pat. No. 4,149,367, and also Ser. No. 12,168, Feb. 14, 1979, now U.S. Pat. No. 4,198,807. Related application Ser. No. 141,028, filed Apr. 14, 1980, is now pending.

BACKGROUND OF THE INVENTION

1. Field of the Invention

This invention is directed to dulled covered wire, covered stranded conductor, covered stranded wire rope, and sheathed individually insulated multiconductors. Such comprises plastic covered electrical or communication conductor, whether solid or stranded wire, single, duplex or multiplex, or metal and electrical or fiber optic light wave dulled or non-specular sheathed factory assembly of one or more conductors each individually insulated and enclosed in the continuous sheath for telephone or communications, said conductors being either metal or fiber glass, and said sheath being either rubber, thermo-plastic, compressed mineral, or metal. This invention also comprises dulled stranded together bare ground strand and covered stranded for electrical service drop for homes and buildings. This invention provides better acceptance of such articles, and comprises both the articles of manufacture and the making of same.

2. Description of Prior Art

The public generally does not like to see overhead telephone or electric service lines coming into their homes. They would prefer them to be invisable and buried. Similar objections have been made to covered communication and power lines, and sheath covered telephone and power cable on streets, highways and cross-country. Similar objections have been made to covered wire rope and cable used for strength rather than electrical or light wave conducting.

Before this invention the products herein had a shiny exterior surface when manufacture of the covered products were completed, and also when the products were first installed and then for years thereafter. It took many years for the shiny reflective exterior surface of outdoor overhead installed covered conductor products or covered wire rope products to dull by weathering and become less conspicuous.

Clear plastic ages and deteriorates when exposed outdoors to the ultraviolet rays of the sun. Gray colored pigment or less expensive lamp black mixed with clear plastic lessens deterioration from sunlight and is widely used for the cover, jacket, or sheath of electrical conductors, cable and steel wire products. The word cover is used herein to also mean outer or exterior layer, or jacket, or sheath; and the word conductor is also used herein to include the word cable.

It is old art to make the cover of said products in various colors for ready means of identification and distinguishing within groups of products.

It is likewise old art that said products are often colored for appearance purposes.

It has not, however, been a function of any step in the prior art of making said products to make the outer surface of the products non-specular or dulled.

The prior art has not combined for these prior covered products the color of the material of the exterior covering with a purposeful surface finish to produce a non-specular covered product.

In the prior art such products are more conspicuous to the public when first erected in public view, causing a public prejudice thereto. Such prejudice has heretofore even prevented outdoor installation or caused the covered products to be buried from public view.

SUMMARY OF THE INVENTION

This invention of covered non-specular products followed the development of bare non-specular products.

Public objection to conspicuous bare stranded overhead transmission line conductor caused the first manufacture of bare non-specular conductor. That non-specular bare stranded aluminum conductor was made by a secret process in 1969. The manufactured shiny bare stranded conductor was made non-specular by abrasive blasting the conductor in an abrasive grit blasting machine commonly used for removing mill scale from steel pipe.

The municipal power department of the City of Los Angeles, the world's largest, prior to 1969, had a history of public resistance to the installation of overhead transmission or distribution lines, or building service drops. It is much costlier to bury such installations than to install them overhead. This Department required a new overhead transmission line in 1969. It heard of the non-specular bare transmission line conductor and advertised for bids.

The bids required the conductor surface and interstices between the ninety fives wires in the conductor to be free of foreign particles. The bid specified that the method used for manufacture shall not be abrasive blasting with sharp abrasive.

The only manufacturer making non-specular conductor made the only bid for the non-specular conductor. The bid was accepted.

The conductor was manufactured using the then secret method of abrasive grit blasting the conductor with sharp garnet sand after the conductor had been completely stranded. Careful laboratory tests disclosed that all the non-specular conductor after manufacture contained deeply embedded abrasives in the interstices between the conductor wires.

Other manufactures soon followed manufacture of bare non-specular stranded aluminum conductor using the sharp abrasive method after completing the stranding of the conductor. Hundreds of millions of pounds of such conductor have since then been made.

The National Standards Association published the standard for reflectance on such conductor as C7.69 in 1976.

No 40 year service life test can be completed before 2020; and no accelerated service life test on grit contaminated bare non-specular stranded aluminum conductor has been made. Each wire in an overhead bare stranded transmission or distribution line is constantly moving relative to each adjacent wire. The movement is due to aeolian vibrations and temperature changes between day and night. Many engineers believe that the embedded sharp grit between the interstices of the wires in aforesaid industry wide manufactured non-specular bare stranded conductor is a substantial detriment to the reliability and service life of the conductor. Increased damping observed in such lines that have been erected indicates a shortened life due to the embedded grit.

On Jan. 16, 1978 application, now U.S. Pat. No. 4,149,367, was made for an uncontaminated non-specular stranded conductor and methods of making same.

Continuation-in-part Pat. No. 4,198,807 using the same methods, but for uncontaminated bare non-specular steel wire products, was granted Apr. 22, 1980; and continuation-in-part application Ser. No. 141,028 filed Apr. 14, 1980, is now pending for all uncontaminated bare non-specular conductor and steel wire products and methods of making same.

The aforesaid patents and application on bare non-specular products are incorporated herein by reference because the methods therein described and claimed are applicable as methods for making the invention herein for the covered products and methods of making of the invention herein.

The primary purpose of this invention is to have on the covered products herein a non-specular or dulled exterior surface when they are first installed at outdoor overhead locations so that they will be more environmentally accepted to the public.

This invention is to non-specularly dull the exterior surface of the covered products during manufacture or in the alternate during or soon after the products are erected for use, instead of having the products in use as shiny objects for many years before the exterior surface reflectance is dulled by weathering.

Another purpose of this invention is to provide an exterior surface dulling on the cover which inhibits the penetration of sunlight into products herein with a plastic cover and thus minimizes the need for the quantity or type of additives to be mixed with the plastic covering so as to protect the covering from deterioration by sunlight.

Another purpose of this invention is to provide an exterior surface dulling on the colored cover of the products herein which cause the products to have a more non-specular color and reflectance when first installed so that they will be more environmentally accepted to the public.

Bare stranded shiny aluminum electrical conductor can be made non-specularly dulled by abrasive blasting the exterior surface wires with sharp grit of between 100 to 300 mesh fineness and producing an average surface profile usually less than 118 microinches peak-to-valley roughness and average maximum reflectivity of 26 to 32 percent, and meet American National Standards Institute C7.69 (1976) for maximum allowable reflectance.

The equipment used for making abrasive blasted non-specularly dulled bare stranded aluminum electrical conductor includes wellknown pipe grit blasting machines for removing mill scale from steel pipe. The abrasives used garnet or silica sands or aluminum oxide.

The same abrasive blasting methods for making non-specularly dulled bare stranded aluminum conductor can be used to make the covered products of the invention herein.

There are several other methods for making the covered products herein non-specularly dulled. One method is to pull the linear body of the covered products between steel rolls, which have a surface finish corresponding to that produced on the non-specular dulled abrasive blasted product covers—which roll the non-specular dulling onto the exterior surface cover of these covered products.

Another method for making the covered products herein non-specular is a very thin coating of sheenless plastic over the exterior surface of the linear body of the products. The sheenless plastic has at least 6.3% by weight of titanium oxide particles the maximum of which is 5μ and which comprise at least 50% by weight of particles having a size of less than 1.0μ thereof, well mixed into the plastic.

Another method is to spray on a non-specularly fogging pigment to dull the exterior surface of the cover of the products herein.

Another method is to electrodepositly fog on a pigment to dull the exterior surface of the cover of the products herein to make them non-specular.

Another method is to electrostatically fog on a pigment to dull the exterior surface of the cover of the products herein to make them non-specular.

Another method is to non-specular dull the exterior surface of the linear bodies of the products herein at intervals rather than continuously along the linear body to produce a camouflaged affect of an alternating shiny and non-specular linear body.

Figure 1:
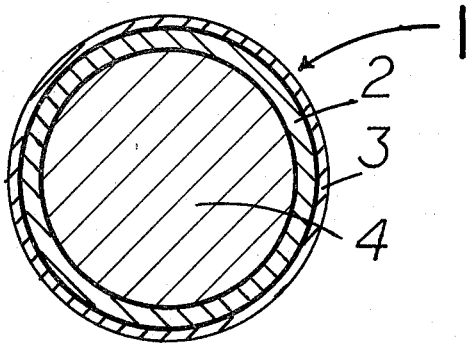
FIG. 1 shows a product of this invention. This product 1 can be a thermoplastic covered single solid wire copper conductor, a plastic sheathed multi-pair telephone cable; a lead covered telephone cable; a plastic extrusion molded covered, differentially compressed, multi-layered, concentric cross lay stranded cable electrical conductor; a jacketed fiber optic light wave conductor; a plastic surfaced wire rope; or any other of the products herein having an outer cover 2. The covering 2 has had its outer surface 3 purposely dulled to a reduced visibility or non-specular surface. The cover 2 encloses the interior components 4 of the product 1, which components may include filler material, spacers and or wrappings around or on inner coverings on conductors or insulated conductor; or component 4 may be the interior of covered wire rope.
Figure 2:
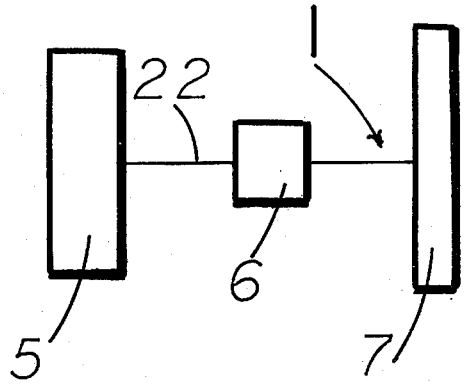
FIG. 2 shows a method of making product 1. Block 5 shows a product 1 before it has been purposely dulled. Block 6 shows the means for making the product 1 dulled so that it becomes less visible or non-specular. Block 7 shows a reel of product 1 which has been pulled from block 5 through block 6. The means 6 may be any of the non-specularly dulling methods described in the foregoing summary of invention and may be accomplished while completing manufacture of the product in a factory, or may be accomplished during or after the product is erected overhead outdoors.
Figure 3:
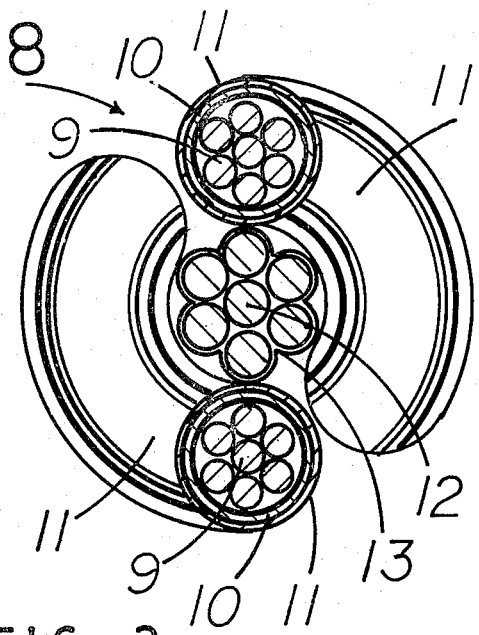
FIG. 3 shows a product 8 of this invention. This article 8 is a building service drop, such as is usually installed for bringing electric service overhead from a power line to a home or building. The bare support strand 12 has a purposely dulled exterior exposed surface 13 to reduce its visibility so as to blend into the the environment where it is to be used. Two insulation covered electrical conductors 9 are twisted over the support strand 12. The insulated covers 10 of the conductors 9 also have a purposely dulled surface 11 to reduce the visibility of the building service drop 8 so as to blend into the environment where it is to be used.
Figure 4:
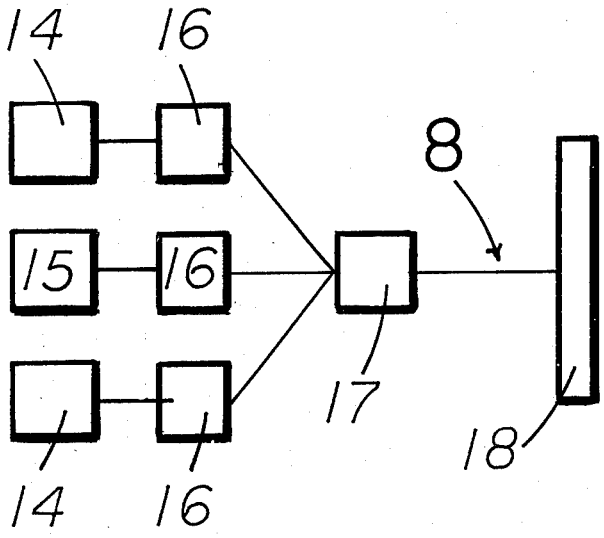
FIG. 4 shows a method of making the building service drop 8. Reels 14 of shiny insulated covered electrical conductor 9 are pulled through a means for dulling 16 the exterior surface 11 of the covers 10 of the conductors 9 and pulled and twisted over the purposely dulled support strand 12, 13 on the wire mill block 17 and pulled onto reels block 18 as reels of non-specular building service drop.
Figure 5A:
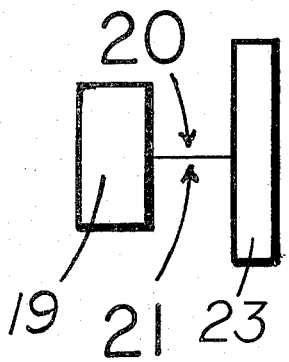
FIG. 5A shows a block diagram of a method of this invention for making camouflaged products. A control 19 intermittently turns on and off the dulling means 6 in FIG. 2 or 16 in FIG. 4 so that when the covered conductor product 1 or building service drop 8 is pulled onto their respective reels 7 or 18 the linear bodies of the products will be a reel 23 of product 20 or 21, which products have alternating undulled exterior surfaces and purposely dulled exterior surfaces to give the linear body of the products a camouflaged aspect. Another method (not shown) for making the non-specular building service drop camouflaged is to intermittently along the linear body make it non-specular surfaced only at intervals and after undulled covered conductors are twisted over bare support strand.
Figure 5B:
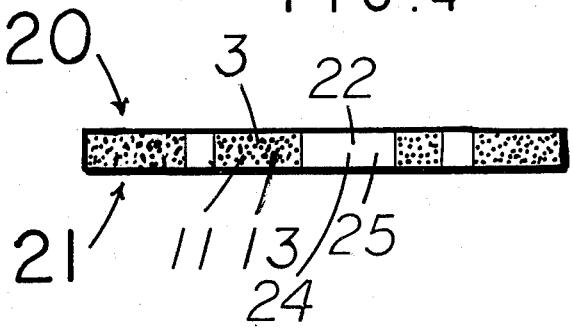

The product of FIG. 5A is shown in FIG. 5B as a camouflaged linear body of conductor 20 with a non-specularly dulled surface finish 3 intermittently with shiny specular surface finish 22.

FIG. 5B is also used for showing camouflaged building service drop 21 as a linear body with a non-specularly dulled surface finish 13 on the guy strand 12, and non-specularly dulled surface finish 11 on the covered conductor 9—intermittently with shiny specular surface finish 24 for the support strand and 25 for the specular covered conductor.

DESCRIPTION OF PREFERRED EMBODIMENT

The preferred embodiment of this invention is abrasive blasting of a dulled finish over the covered otherwise shiny coverings.

This invention having been described in its preferred embodiment, it is clear that it is susceptible to numerous modifications and embodiments with the ability of those skilled in the art and without the exercise of the inventive faculty. Accordingly, the scope of this invention is defined by the scope of the following claims:

What is claimed is:

1. A covered plurality of insulated conductors, which comprise:
   (a) a cover;
   (b) a plurality of insulated conductors within the cover;
   (c) a non-specular or dulled exterior on the surface of the cover.

2. The article as recited in claim 1, further comprising: a material composition and surface finish of the cover so that the covered plurality of conductors is non-specular.

3. The article as recited in claim 1, further comprising: the material of the cover being black colored thermoplastic with a sufficiently non-specular or dulled surface.

4. The article as recited in claim 1, further comprising: the material of the cover being gray colored thermoplastic with a non-specular or dulled surface.

5. The article as recited in claim 1, further comprising: the insulated conductors being metal and electricity conducting.

6. The article as recited in claim 1, further comprising: the insulated conductors being one or more fiber optic and light wave conducting.

7. The article as recited in claim 1, further comprising: the cover being a plastic.

8. The article as recited in claim 1, further comprising: the cover being a metal.

9. A method of making the article of claim 1, comprising:
   (a) abrasive blasting the surface of the cover;
   (b) making the appearance of the covered plurality of conductors non-specular or dulled.

10. A method of making the article of claim 1, comprising:
   (a) rolling on a surface finish on the cover;
   (b) making the appearance of the covered plurality of conductors non-specular or dulled.

11. A method of making the article of claim 1, comprising:
   (a) fogging on a pigmented surface finish on the cover;
   (b) making the appearance of the covered plurality of conductors non-specular or dulled.

12. A multi-sheathed gas pressurized communication cable with a plurality of insulated conductors, wherein the improvement comprises:
   (a) an outer sheath with,
   (b) a non-specular or dulled exterior surface finish on the outer sheath.

13. A covered communication cable with a plurality of insulated conductors, wherein the improvement comprises: a dulled or non-specular exterior surface on the cover.

14. A covered electrical conductor, wherein the improvement comprises:
   (a) a dulled finish on the surface of the conductor cover with,
   (b) a material composition and surface finish of the cover so that the conductor is non-specular within the limits for non-specular bare stranded aluminum conductor of ANSI C 7.69 (1976).

15. A building service drop of two insulated stranded wire conductors twisted over a bare guy strand, wherein the improvement comprises:
   (a) a non-specular or dulled surface on each insulated conductor.
   (b) a non-specular or dulled surface on the guy strand.

16. A twisted plurality of covered electrical conductors, wherein the improvement comprises: a non-specular exterior surface on the covers.

17. A covered wire rope, wherein the improvement comprises: a non-specular surface on the wire rope covering.

18. The article of claim 1, further comprising: the covering being a linear body on which the non-specular or dulled finish on the exterior surface of the cover is only at intervals so that the covered plurality of conductors has a camouflaged affect.

19. A covered linear body, such as a covered electrical conductor, plastic sheathed multi-conductor communication cable, jacketed fiber optic light wave conductor, lead sheathed telephone cable, building service drop, or plastic covered wire rope, wherein the improvement comprises: a non-specularly dulled exterior surface on the covering alternately with a specular surface along the linear body making a camouflaged affect.

20. The process of making the article of claim 19 comprising:
   (a) providing a specular covered linear body, including a cover;
   (b) applying a non-specularly dulling finish to the exterior surface of the cover intermittently along the specular covered linear body making a camouflaged affect.

* * * * *